US008615823B2

(12) United States Patent
Heath

(10) Patent No.: US 8,615,823 B2
(45) Date of Patent: Dec. 31, 2013

(54) DUAL ACTION FLUSHING ASSEMBLY FOR TOILETS

(76) Inventor: Edward H. Heath, Franklin, CT (US)

( * ) Notice: Subject to any disclaimer, the term of this patent is extended or adjusted under 35 U.S.C. 154(b) by 1172 days.

(21) Appl. No.: 11/198,827

(22) Filed: Aug. 5, 2005

(65) Prior Publication Data

US 2006/0026745 A1 Feb. 9, 2006

Related U.S. Application Data

(60) Provisional application No. 60/599,409, filed on Aug. 6, 2004.

(51) Int. Cl.
*E03D 5/00* (2006.01)

(52) U.S. Cl.
USPC ..... 4/405

(58) Field of Classification Search
USPC ..... 4/324–327, 410–415
See application file for complete search history.

(56) References Cited

U.S. PATENT DOCUMENTS

| | | | | | |
|---|---|---|---|---|---|
| 2,963,710 | A | * | 12/1960 | Carter | 4/413 |
| 3,005,206 | A | * | 10/1961 | Dollinger | 4/327 |
| 3,234,566 | A | * | 2/1966 | Rupp | 4/410 |
| 3,561,015 | A | * | 2/1971 | Moore | 4/410 |
| 3,758,893 | A | * | 9/1973 | Smolinski et al. | 4/327 |
| 3,777,316 | A | * | 12/1973 | Coetzee | 4/324 |
| 3,869,733 | A | | 3/1975 | White | |
| 4,042,982 | A | | 8/1977 | Contreras | |
| 4,110,850 | A | * | 9/1978 | Tedei | 4/326 |
| 4,115,882 | A | | 9/1978 | Paulus | |
| 4,141,092 | A | * | 2/1979 | Jones | 4/324 |
| 4,173,801 | A | | 11/1979 | Bresnyan | |
| 4,504,984 | A | | 3/1985 | Burns | |
| 4,829,605 | A | | 5/1989 | Agostino | |
| 5,261,129 | A | | 11/1993 | Roy | |
| 5,396,666 | A | * | 3/1995 | Tsai et al. | 4/325 |
| 5,813,059 | A | | 9/1998 | Wang | |
| 5,881,399 | A | | 3/1999 | Kartoleksono et al. | |
| 5,979,492 | A | | 11/1999 | Miller | |
| 6,041,452 | A | | 3/2000 | Hsiao et al. | |

FOREIGN PATENT DOCUMENTS

| | | | |
|---|---|---|---|
| CN | 2214973 | Y | 12/1995 |
| CN | 2430483 | Y | 5/2001 |
| CN | 2491500 | Y | 5/2002 |

OTHER PUBLICATIONS

Chinese Office Action for CN2005101173085, dated Sep. 11, 2009., 17 pgs.

* cited by examiner

*Primary Examiner* — Lori Baker
(74) *Attorney, Agent, or Firm* — Bachman & LaPointe, P.C.

(57) ABSTRACT

A flusher assembly includes a main body adapted for mounting to a toilet tank; and a flush handle assembly having a shaft rotatably mounted within the main body and operable in a full flush rotation position and a limited flush rotation. The assembly is simple, reliable and efficiently manufactured, and allows selection of full or limited volume flushing of toilets and, thereby, conservation of water.

8 Claims, 3 Drawing Sheets

DUAL ACTION FLUSHING ASSEMBLY FOR TOILETS

CROSS REFERENCE TO PROVISIONAL APPLICATION

This application claims the benefit of the filing date of provisional application Ser. No. 60/599,409 filed Aug. 6, 2004.

BACKGROUND OF THE INVENTION

The invention relates to flushing assemblies for toilets such as flapper-style toilets and the like, and more particularly, to a flushing assembly which allows the user to select the volume of flush desired and thereby save water when a full flush is not needed.

So-called water saving toilets are known in the art, and are intended to conserve water by reducing the water used in a flush. Unfortunately, these toilets and associated flushing systems tend to use far more water than intended, and nevertheless provide a single volume flush. The need exists for an improved method of conserving water during operation of a toilet.

It is therefore the primary object of the present invention to provide an apparatus which allows improved conservation of water.

It is a further object of the present invention to provide such an apparatus which is simple in manufacture, simple to install, and simple and reliable in use.

Other objects and advantages of the present invention will appear below.

SUMMARY OF THE INVENTION

In accordance with the present invention, the foregoing objects and advantages have been readily attained.

According to the invention, a flushing assembly is provided which comprises a main body adapted for mounting to a toilet tank; and a flush handle assembly comprising a shaft rotatably mounted within the main body and operable in a full flush rotation position and a limited flush rotation position.

In accordance with the present invention, the two different operative positions of the flush handle assembly allow a user to selectively perform a full flush when needed, and a limited volume flush when sufficient, so that to conserve water.

The structure of the flush handle assembly is configured such that, in the limited flush rotation position, the flush handle assembly can be operated only to cause a partial flush of the toilet and, thereby, only allow a portion of the normal volume of a full flush to pass into the bowl.

Additional details of the present invention will be more clear upon a consideration of the following detailed description.

BRIEF DESCRIPTION OF THE DRAWINGS

A detailed description of preferred embodiments of the present invention follows, with reference to the attached drawings, wherein.

DETAILED DESCRIPTION

The invention relates to a flushing assembly for use in toilets which flush through pivot of a portion of a handle assembly wherein the amount of pivot controls the volume of the flush. One non-limiting example of such a toilet is a flapper-style toilet, although other styles of toilet, for example some pressure type toilets, can also advantageously operate with the apparatus of the present invention. Flapper-style toilets, are well known, and have a water tank wherein a supply of water is stored for use in flushing. Inside the tank, there is a flapper valve which can be lifted to allow the water within the tank to flush the bowl of the toilet in well known fashion. In order to perform a flush, the flapper is typically connected through a chain or other connector to a lift arm, which itself is operatively connected to a handle external of the tank. Thus, pushing of the handle lifts the lift arm and opens the flapper to perform a flush.

In accordance with the present invention, a flusher assembly is provided which advantageously has two different flush positions, one wherein a normal full flush rotation can be performed, and another where only a limited flush rotation can be performed, wherein the limited rotation is sufficient to partially lift the flapper and allow some water to escape the tank into the bowl, but wherein the flapper is not fully lifted to perform a complete flush as with normal operation. This advantageously allows a user to perform a limited flush rotation when such a flush will be sufficient, and to configure the flushing assembly into the proper position for performing a full flush rotation when needed.

Figure 1:
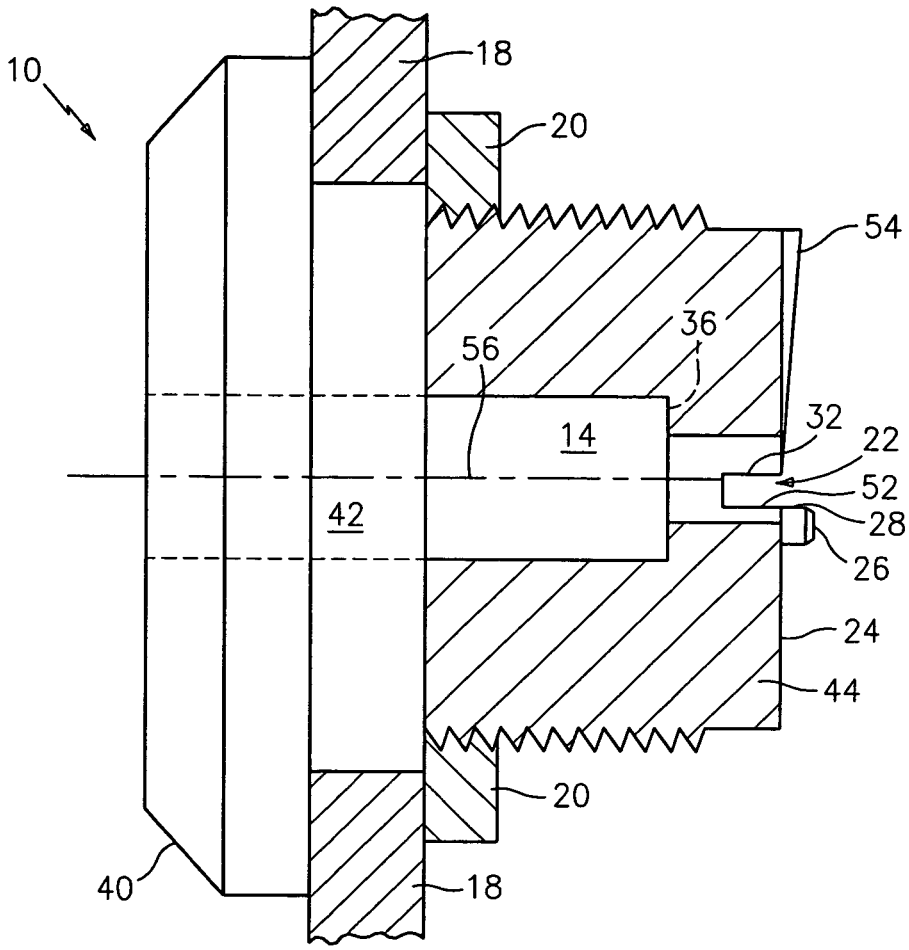
FIG. 1 is a top view of the main body of a flushing assembly in accordance with the present invention.
Figure 2:
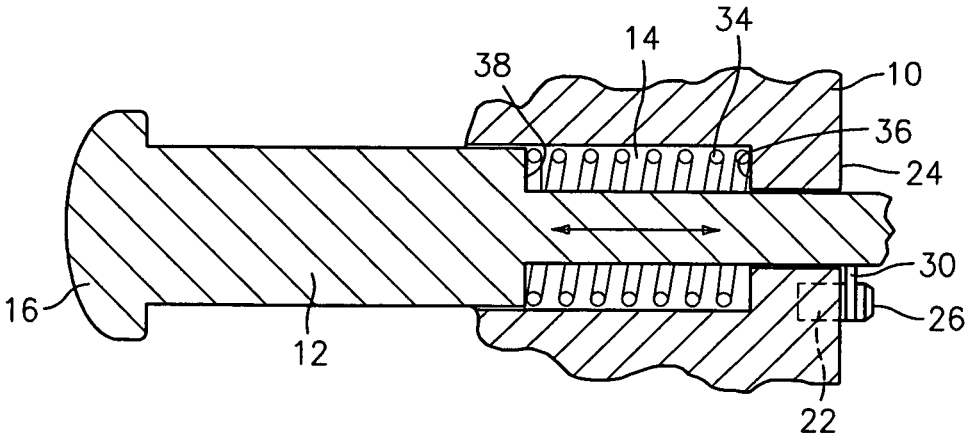
FIG. 2 is a side view of a portion of a main body and a shaft of the flush handle assembly in accordance with an embodiment of the present invention.
Figure 3:
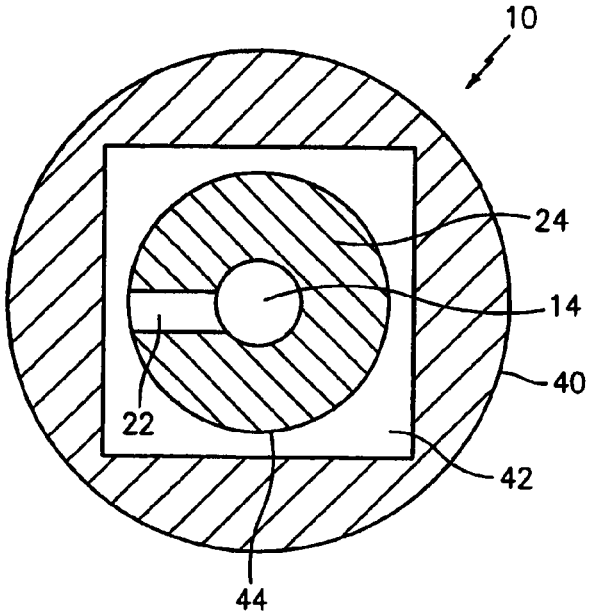
FIG. 3 is an end view of a main body component of a flushing assembly in accordance with the present invention.

FIGS. 1-3 schematically illustrate elements of the flushing assembly in accordance with the present invention. In this regard, FIG. 1 is a top partially schematic view of the main body portion of a flushing assembly. FIG. 2 shows a shaft 12 of a flush handle assembly in accordance with the present invention and a portion of a main body 10 into which the shaft is rotatably mounted.

As will be evident from a discussion of details to follow, FIG. 1 is a top view of one embodiment In accordance with the present invention, while FIG. 2 shows certain structures in an inverted position to illustrate that various positioning of components are all when within the broad scope of the present invention. Referring further to FIG. 1, main body 10 advantageously defines an inner passage 14 into which shaft 12 is rotatably positioned, and main body 10 is typically mounted through a tank wall 18 and secured in tank wall 18 using a nut 20 in well known fashion.

As shown in FIG. 2, shaft 12 typically has a handle 16 which, in well known fashion, can be used to impart rotation of shaft 12 relative to main body 10 in well known fashion so as to cause a flush as desired.

Returning to FIG. 1, main body 10 advantageously has a slot 22 which, in this embodiment, is positioned at an end 24 which faces toward the inside of the tank. This end 24 will be referred to herein as a tank-inside facing end.

Also as shown in FIG. 1, in one preferred embodiment, a return stop 26 can advantageously be positioned extending further into the tank from end 24, and advantageously having a return surface 28 aligned with slot 22. As will be further discussed below, stop 26 advantageously helps to insure proper return of the flushing assembly to a rest position within slot 22 following a full flush.

In accordance with the invention, shaft 12 advantageously has a rest position relative to main body 10, and can advantageously be biased toward this rest position, but can be moved axially, along a longitudinal axis of shaft 12, relative to main body 10, into a different rotating position. According to a preferred embodiment of the present invention, the rest position is a position wherein a surface, preferably a pin 30 (FIG. 2) is positioned within slot 22 so that rotation of shaft 12 relative to main body 10 is limited by the extent to which pin 30 can rotate within slot 22. The amount of rotation allowed, which is dictated by the position of stop surface 32, should be selected to be sufficient to allow a lifting of the flapper of only a relatively small degree, for example, about one-half to one and one-half inches more or less, depending upon chain slack and other flapper or flushing mechanism variables. The amount of rotation should be sufficient to allow limited water flow from the tank to the bowl of the toilet, preferably suitable for clearing a bowl containing only liquid and paper waste, without causing a full flush.

When shaft 12 is moved axially relative to main body to the full flush rotation position, which is as is illustrated in FIG. 2, pin 30 is not radially within slot 22, and shaft 12 can therefore rotate normally relative to main body to allow a complete rotation and, thereby, a complete lifting of the lift arm structure and full lifting of the connected flapper as is well know.

A spring 34, schematically illustrated in FIG. 2, can advantageously be provided within inner passage 14 and engage between shaft 12 and main body 10 so as to bias shaft 12 toward the limited flush rotation position. In this regard, spring 34 can be seated between a spring stop surface 36 defined within main body 10, and a shoulder 38 of shaft 12. Of course, other structures can be defined within main body 10 or on shaft 12 to similarly engage with spring 34. For example, instead of should 38, shaft 12 could be provided having an additional pin or other structure against which spring 34 can apply its force.

The rear illustration of FIG. 3 further shows additional detail of main body 10. Referring to FIGS. 1 and 3 collectively, main body 10 typically has a head 40 which typically lies outside the tank wall 18 when installed therein. Head 40 can have a rearwardly projecting inner portion 42, in this embodiment a square inner portion 42, which is configured to fit the opening within tank wall 18 and thereby prevent rotation of main body 10 relative to tank wall 18 when mounted therein.

A sleeve or substantially cylindrical portion extends further toward the inside of the tank from head 40 and square inner portion 42, and this sleeve is referred to as element 44. Sleeve 44 in the embodiment shown has threads which engage with nut 20 to allow for mounting. Sleeve 44 also advantageously defines inner passage 14, and end 24 having slots 22 and return stop 26, all as shown in FIGS. 1 and 3. Main body 10 can be formed of any suitable material, either as a plastic injection molded or otherwise formed part, or can be made through any other well know manufacturing process.

Figure 4:
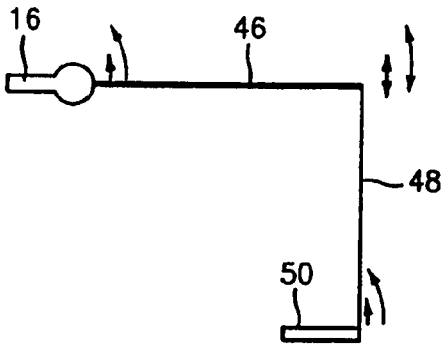
FIG. 4 schematically illustrates operation of an apparatus In accordance with the present invention.
Figure 4A:
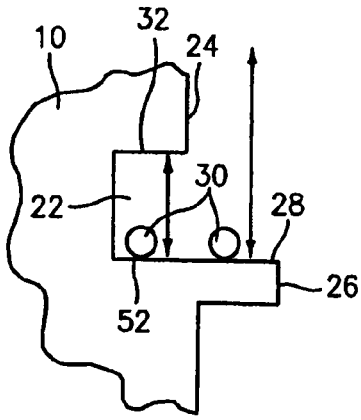
FIG. 4*a* further schematically illustrates a portion of the main body and a portion of a shaft of the flush handle assembly in the two different operating positions in accordance with the present invention.

Referring to FIGS. 4 and 4*a*, operation of the apparatus in accordance with the present invention is further illustrated.

FIG. 4 schematically shows handle 16 and a lift arm 46 connected through a chain 48 to a flapper 50. In accordance with the present invention, two different operating positions are defined by the shaft and flushing assembly of FIGS. 1-3 which are positioned between handle 16 and lift arm 46. In the limited flush rotation position, which is preferably the rest position of the apparatus of the present invention, pin 30 is positioned within slot 22 as schematically illustrated in FIG. 4*a* as the left position of pin 30 in the drawing. As shown, slot 22 and, particularly, stop surface 32, engages pin 30 upon rotation of shaft 12 and resulting pivot of pin 30, and prevents shaft 12 and pin 30 from rotating beyond the point of contact of pin 30 with stop surface 32. This amount of rotation is selected to provide only a limited lift of lift arm 46 and, resultingly, only a limited lift of flapper 50, as schematically illustrated in FIG. 4 by the relatively smaller arrows at handle 16, lift arm 46 and flapper 50. When a full flush is desired, the assembly is configured to the full flush rotation position, which is accomplished with the preferred embodiment by axially positioning shaft 12 toward the inside of the tank so as to axially slide pin 30 out of slot 22 the right-side position of pin 30 as shown in FIG. 4*a*. In this position, stop surface 32 of slot 22 is not aligned to prevent rotation of pin 30. Thus, a full or otherwise normally allowed range of rotation of shaft 12 and pivot of pin 30 can be accomplished in this position. This results in a full rotation of handle 16, a full lift of lift arm 46 and a full opening of flapper 50 as schematically illustrated in FIG. 4 by the relatively larger arrows.

After pin 30 has been pivoted along with rotation of shaft 12 to a flush position, the weight of lift arm 46 or any other structure biases the handle 16 and lift arm 46 back to a rest position. In a limited flush, this will result in pin 30 returning back toward the return surface 52 of slot 22. When returning from a full flush, pin 30 is outside of slot 22. If the return movement is sufficiently rapid, pin 30 could skip past slot 22 and remain outside of same for the next flush. Since this is undesirable, in accordance with the preferred embodiment, return stop 26 is positioned as schematically also illustrated in FIG. 4*a*, and return stop 26 catches pin 30 when pin 30 is in alignment with slot 22 so that the bias of spring 34 can push shaft 12 to the rest position with pin 30 inside slot 22 as desired. In order to accomplish this, it is most preferred that return stop 26 have stop surface 28 aligned, preferably coplanar, with return surface 52 of slot 22 as shown.

Figure 5:
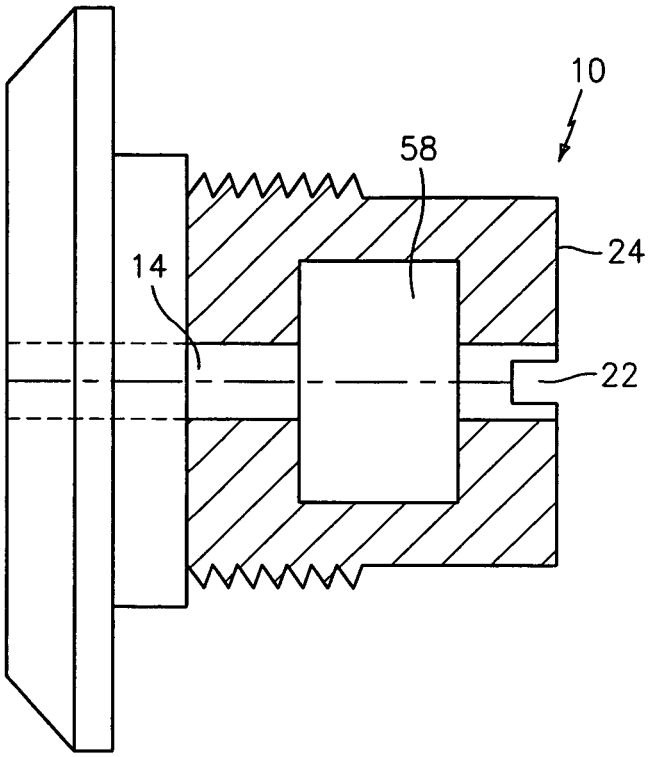
FIG. 5 illustrates the main body portion of an alternative embodiment of the flushing assembly of the present invention.

In accordance with a further alternative embodiment of the present invention, and as shown in FIG. 1, tank-inside facing end 24 of main body 10 can advantageously have a sloped portion 54 which is positioned to help guide pin 30 back into slot 22 during return rotation after a flush in the full flush rotation position. Thus, in this embodiment, end 24 has a surface or portion 54 which is sloped relative to a perpendicular plane with respect to the axis 56 of main body 10. Advantageously, the slope of portion 54 is toward slot 22 as shown in FIG. 1. Of course, different angles of the sloped portion 54 can be selected depending upon effectiveness of positioning pin 30 within slot 22 as desired. FIG. 5 shows a further alternative embodiment in accordance with the present invention wherein a spring insertion access 58 is provided to allow for positioning of spring 34 within inner passage 14 so that components of the shaft assembly can be inserted through inner passage 14 and spring 34 after positioning of the spring. Access 50 can therefore advantageously be opening through the side wall of sleeve 44 which is of sufficient size to position the spring there through, preferably with some compression of the spring so that the spring extends beyond the extent of access 58 after proper positioning within inner passage 14.

Figure 6:
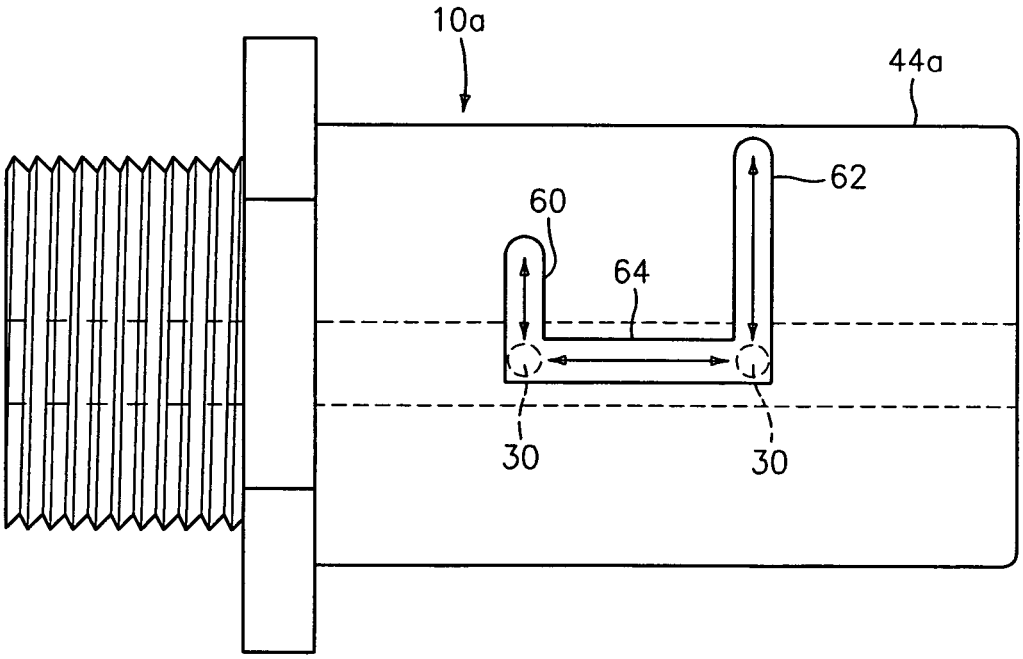
FIG. 6 schematically illustrates a further alternative embodiment In accordance with the present invention.

Turning now to FIG. 6, a further alternative embodiment of the present invention is shown. In this embodiment, main body 10 is of an alternative configuration wherein the threads are positioned in a different location for securing to the tank wall. Of course, this is an alternative to the structure shown in the other figures, and numerous other structures for mounting in the tank wall can be used, all well within the broad scope of the present invention. As shown in FIG. 6, sleeve 44*a* of main body 10*a* has a series of slot portions 60, 62, 64 defined therein. A first slot portion 60 is a radial slot and is positioned to define a limited range of motion in the limited flush rotation position. Slot 62 is a second radial slot and has a radial length which is greater than slot 60, and slot 62 corresponds to a full flush rotation position. Axial slot 64 advantageously connects slot 60 and 62 such that pin 30 can travel along slot 60, 62, 64 for operation as desired within slot 60 and 64, and positioning between slots 60 and 64 through slot 62. Preferably, axial slot 62 is positioned connecting a rest or return-position end of slot 60, 64, such that axial positioning of pin 30 relative to main body 10*a* is accomplished when the assembly is in the rest position.

Slot 60, 62, 64 are advantageously sized to receive pin 30 with a small amount of clearance to provide for a smooth but reliable operation as desired.

As mention above, it should be appreciated that slot 22 can be positioned in any of a large number of different positions in the structure of main body 10. In the embodiment of FIG. 1, slot 22 is positioned in a substantially 12-o'clock position. In the embodiment of FIG. 2, slot is positioned at the opposite position, or at approximately 6-o'clock. It should be appreciated that this structure can be defined at any other location around the periphery of main body 10, and can also be positioned in other places besides end face 24. End face 24 is desired, however, due to ease of assembly since slot 22 can easily accept pin 30 during assembly of the device.

From a consideration of the foregoing, it should be readily appreciated that a simple and effective method and structure have been provided to allow for different volumes of flushing as desired and selected by a user, which advantageously provides the desired function of allowing a user to select the volume of a flush of the toilet depending upon the needs of the particular circumstances. Specifically, the limited flush will generally be suitable when the toilet contains only liquid and/or paper waste. Further, when a full flush is necessary, the assembly is easily operated to provide for same.

Figure 4B:
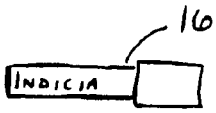
FIG. 4*b* schematically illustrates the flush handle with indicia in accordance with the present invention.

In further accordance with the invention, it may also be desirable to provide indicia, for example, on the handle 16, which conveys to a user that a full flush can be accomplished by axially displacing the handle assembly relative to the main body (See FIG. 4*b*). This can be conveyed through text, for example, "push for full flush", or with arrows and pictures or the like.

It should be appreciated that the present invention provides an apparatus which operates in an easy and reliable fashion. The apparatus of the present invention also eliminates complicated mechanisms which might otherwise be attempted in order to provide the function of the present invention, such that the present invention provides simple manufacture and can be used simply and dependably for an extended period of time.

It should also be appreciated that the above detailed description provides explanation of various preferred embodiments of the present invention. However, these embodiments are illustrated only, and are not to be construed as limiting upon the scope of the present invention, which instead is defined by the claims which follow.

What is claimed is:

1. A flusher assembly for a toilet having a single flapper valve, comprising:

a main body adapted for mounting to a toilet tank; and a flush handle assembly comprising a shaft rotatably mounted within the main body and operable in a full flush rotation position and a limited flush rotation position, the flush handle assembly further comprising a handle connected to the shaft, a lift arm extending from the shaft, and a chain attached from the lift arm to the single flapper valve, whereby flushing in the limited flush rotation position lifts the chain and the single flapper valve to a partially open position, and flushing in the full flush rotation position lifts the chain and the single flapper valve to a fully open position, wherein the main body has a slot, wherein the shaft has a surface which engages the slot in the limited flush rotation position, and wherein the surface is outside the slot in the full flush rotation position, wherein the slot is on a tank-inside facing end of the main body, wherein the surface of the shaft is a pin extending radially from the shaft, wherein the tank-inside facing end of the main body terminates in a sloped end surface along which the pin moves when the assembly is flushed in the full flush rotation, and wherein the sloped end surface is sloped toward the slot with respect to a surface perpendicular to the axis of the main body, whereby the sloped end surface guides the pin back to the slot when the shaft is returning to a rest position from a full flush pivoted position.

2. The assembly of claim 1, wherein the shaft has an axis, and wherein the shaft is movable axially between the full flush rotation position and the limited flush rotation position.

3. The assembly of claim 1, wherein the shaft is biased toward the limited flush rotation position.

4. The assembly of claim 1, wherein the main body and the shaft have rotation limiting surfaces which engage at a limited maximum rotation position when the shaft is in the limited flush rotation position.

5. The assembly of claim 1, further comprising a return stop surface extending from the tank-inside facing end of the main body and aligned with the slot whereby, when the shaft is returning to a rest position from a full flush pivoted position, the return stop surface guides the pin into the slot.

6. The assembly of claim 1, further comprising a return stop surface positioned on at least one of the main body and the flush handle assembly and positioned to guide the shaft to the limited flush rotation position from a full flush pivoted position.

7. The assembly of claim 1, further comprising indicia on the flush handle assembly indicating a direction of movement of the shaft relative to the main body for positioning the shaft between the full flush rotation position and the limited flush rotation position.

8. The assembly of claim 7, wherein the indicia is on the handle.

* * * * *